US007206260B1

(12) United States Patent
Klein

(10) Patent No.: US 7,206,260 B1
(45) Date of Patent: Apr. 17, 2007

(54) INTERVAL TIMER

(76) Inventor: Dennis M. Klein, 4646 Via Canada, Thousand Oaks, CA (US) 91329

( * ) Notice: Subject to any disclaimer, the term of this patent is extended or adjusted under 35 U.S.C. 154(b) by 0 days.

(21) Appl. No.: 11/287,013

(22) Filed: Nov. 23, 2005

(51) Int. Cl.
*G04F 10/00* (2006.01)
*G04B 37/00* (2006.01)

(52) U.S. Cl. ..... 368/107; 368/108; 368/88

(58) Field of Classification Search ..... 368/107–109, 368/88, 96, 276, 316
See application file for complete search history.

(56) References Cited

U.S. PATENT DOCUMENTS 3,878,370 A 4/1975 Santomango et al.
4,451,158 A * 5/1984 Selwyn et al. ..... 368/63
D288,176 S * 2/1987 Chan ..... D10/30
4,888,748 A 12/1989 Lagasse et al.
5,140,564 A * 8/1992 Rich ..... 368/107
5,442,600 A * 8/1995 Kutosky ..... 368/109
2001/0034256 A1 10/2001 Green
2002/0093882 A1 7/2002 Garlock
2004/0145114 A1 7/2004 Ippolito et al.
2005/0135196 A1 6/2005 Rund

* cited by examiner

*Primary Examiner*—Vit Miska
*Assistant Examiner*—Thanh S. Phan
(74) *Attorney, Agent, or Firm*—Jack C. Munro

(57) ABSTRACT

An interval timer that is constructed of a polygonal shaped housing which has a time display screen and a pressure activating button within one surface of the housing and another surface of the housing includes a mode selection switch, time increment button and second time increment button. With the mode selection switch in the set position the first time increment button and second time increment button can be operated to produce a selected time value such as in minutes and in seconds to be displayed within the time display screen. Movement of the mode selection switch to a usage position and pressing of the pressable activating button will result in the selected preset time interval to count down a second at a time (or other minimum time increment) to eventually reach zero.

7 Claims, 2 Drawing Sheets

INTERVAL TIMER

BACKGROUND OF THE INVENTION

1. Field of the Invention

The subject matter of this invention is directed to timers and more particularly to a timer that is to start with a selected preset timer interval and then count down to a zero value.

2. Description of the Related Art

The subject matter of the present invention has been found to have particular utility when used in conjunction with games. However, it is considered to be within the scope of this invention that the timer of the present invention could be utilized in environments other than games.

In the playing of games, frequently there is an established time period that is required for a player to perform a playing action. In chess, a player is required to perform a move of a playing piece within a matter of a few minutes. There are also known word games which require players to perform a certain action within a certain allotted period of time. The same is true for the game of Scrabble™ as well as numerous other types of games.

In the marketing of a game, a timer is generally only one small part of the overall structure of the game. Frequently, there are a playing board, playing pieces as well as written material. In order to keep the game at a price level which would facilitate purchasing by consumers, it is necessary to have all parts of the game constructed as inexpensively as possible. In the past, in order to keep the cost at a reasonable level, there have been utilized an hourglass timing device which moves sand between compartments through a restricting passage. Such an hourglass type of timer is not particularly desirable because it does not display to the game player how much time is left. The game player can only guess by looking at how much sand has moved from one compartment to the other compartment. Knowing how much time is left is desirable by almost all players. Furthermore, to re-use an hourglass timer, players must wait until all the sand has reached the lower compartment. Only then may it be inverted to start measurement of a full new time interval. This may result in "dead time" if an action has been completed prior to the hourglass emptying.

Additionally, electronic timers have not proved to be desirable as not only are such expensive but are complicated to use. It would be desirable to design a timer that would be not only simple in construction but simple to use requiring a minimum amount of steps in order to program the timer with the selected time interval and it would also be simple to use requiring only the single act of initiating a sequential decreasing of the selected time interval to a zero value.

SUMMARY OF THE INVENTION

The first basic embodiment of the present invention is directed to an interval timer which utilizes a polygonal shaped housing which has a front side and an another side. A time display screen is mounted on the front side. A pressable activating button is mounted on the front side. A mode selection switch is mounted on the another side. The mode selection switch is movable between a usage position and a set position. A first pressable time increment button is mounted on the another side. When this first pressable button is pressed and the mode selection switch is in the set position the time display screen will display a first numerical time value and continued pressing of the first pressable button will increase the value of the first numerical time value and when the first pressable button is no longer being pressed a selected value will be displayed in the time display screen. A second pressable time increment button is mounted on the another side. When this second pressable button is pressed and the mode selection switch is in the set position the time display screen will display a second numerical time value and continued pressing of the second pressable button will increase the value of the second numerical time value and when the second pressable button is no longer being pressed a selected value will be displayed in the time display screen. In the present embodiment, the settable time values are minutes and seconds. Movement of the mode selection to the usage position will result in the selected value of both minutes and seconds to be displayed as a preset interval time. Operating of the pressable activating button will result in the interval time to begin decreasing in minimum time increments toward a zero value. Electronics are incorporated in the housing for producing of this selected preset interval time.

A further embodiment of the present invention is where the first basic embodiment is modified by defining that only the time display screen and pressable activating button are mounted on the front side.

A further embodiment of the present invention is where the first basic embodiment is modified by defining that there is incorporated a plurality of pedestals on the another side with these pedestals to be used to facilitate placing of the housing on a supporting surface.

A second basic embodiment of the present invention comprises a method of constructing and using an interval timer comprising the steps of placing appropriate electronics within a polygonal shaped housing having a front side and an another side, placing a time display screen and a pressable activating button in conjunction with the front side, placing a mode selection switch, a first pressable time increment button and a second pressable time increment button in conjunction with the another side, locating the mode selection switch in a set position, pressing sequentially both the time increment buttons to produce by the electronics a selected interval time value to be displayed in the time display screen, moving the mode selection switch to a usable position, locating the front side to be accessible and pressing the pressable activating button which causes the selected interval time to decrease a second at a time to eventually get to a zero value.

A further embodiment of the present invention is where the second basic embodiment is modified by placing of a plurality of pedestals on the another side which are to be placed against a supporting surface.

A further embodiment of the present invention is where the second basic embodiment is modified by incorporating of a sound speaker with the electronics which is to produce an audible sound upon the zero value being displayed in the time display screen.

A further embodiment of the present invention is where the second basic embodiment is modified by incorporating a battery within the housing to provide electrical power to the electronics.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
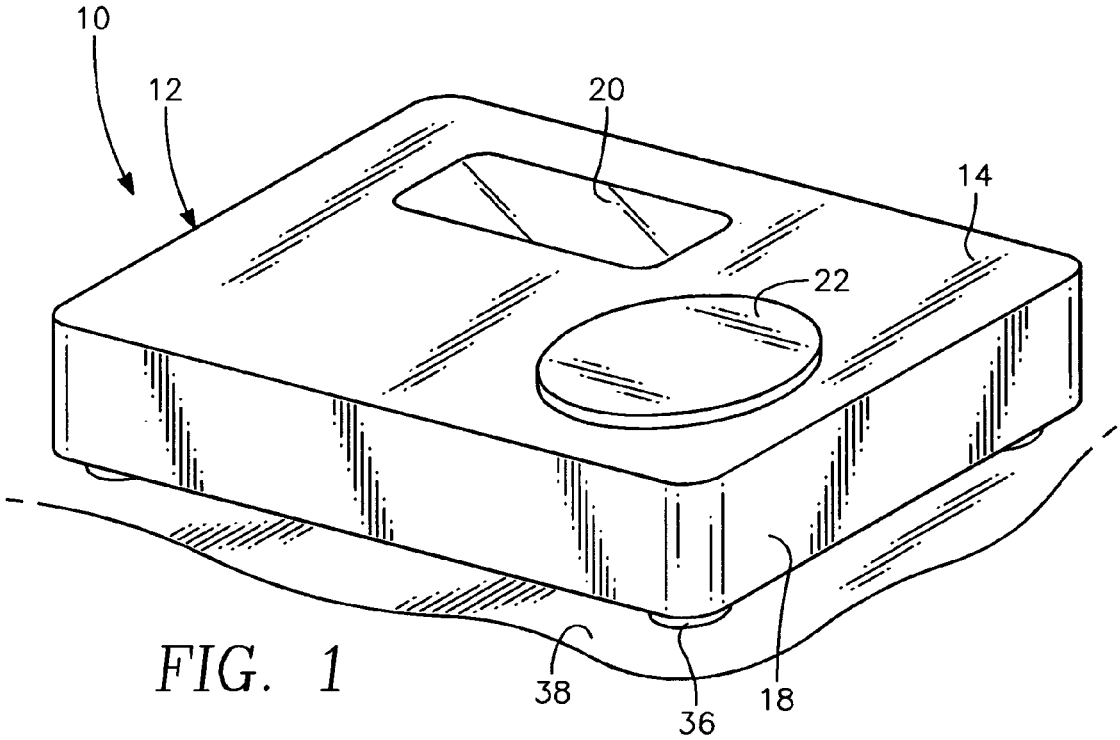
FIG. 1 is an exterior isometric view showing the front side of the housing of the interval timer of the present invention.
Figure 2:
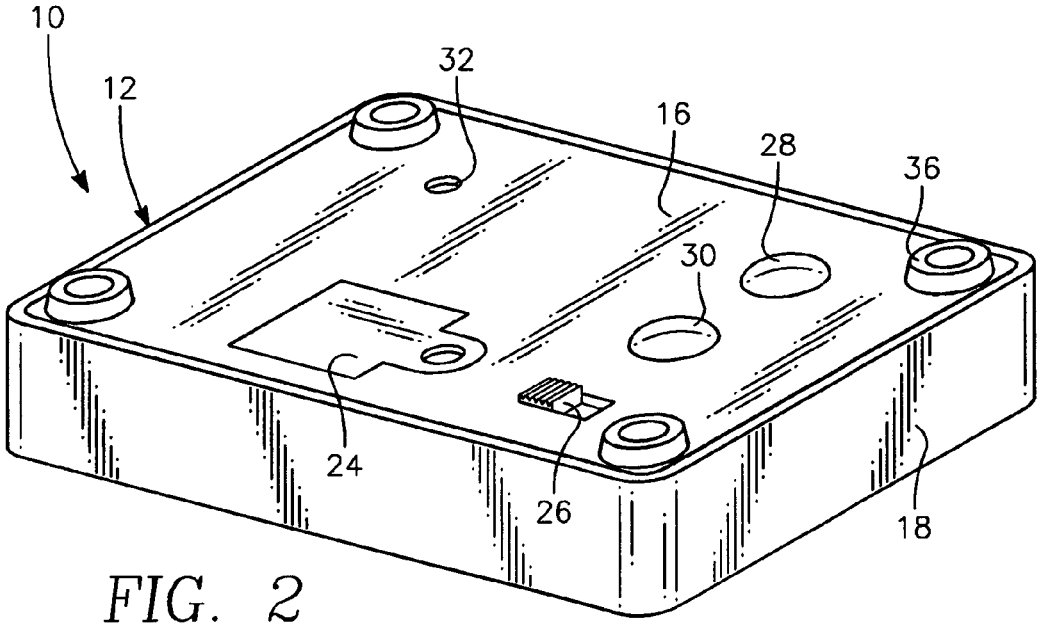
FIG. 2 is an isometric view of the back side of the housing of the interval timer of the present invention.

Referring particularly to the drawings, there is shown in FIGS. 1 and 2 the interval timer 10 of this invention. The interval timer 10 utilizes a housing 12. The housing 12 is shown to be basically in the shape of a box that being polygonal shaped. However, it is considered to be within the scope of this invention that the housing 12 could comprise other shapes, such as spherical, oblate, spheroid or any other desirable configuration. Polygonal is meant to include any structure that has two or more sides. For example, a basic sphere shape that includes a flat section is deemed to be polygonal shaped.

The housing 12 includes a front side 14 and an another side, which is shown in FIG. 2 to be the back side 16. The front side 14 and the back side 16 are connected together by a sidewall 18. The front side 14 includes a time display window 20. Located directly adjacent the window 20 but spaced therefrom is an enlarged pressable activating button 22. The back side 16 includes a removable cover 24 which when removed provides access into a battery containing compartment, which is not shown. Mounted also in the back side 16 is a mode selection switch 26 which is in the form of a slide switch. The mode selection switch is to be movable between a timer usage position and a set position. Also incorporated within the back side 16 are a pair of pressable time increment buttons defined as a minute button 28 and a second button 30. However, the button 28 need not only be used for minutes but could be used for hours or other time increments. The same is true for the seconds button. Also, another button could be added for an additional time increment, such as hours, that would produce a preset time interval of hours, minutes and seconds. Plus, a time increment of tenths of seconds could be used. Also incorporated in the back side 16 is an opening 32.

Figure 3:
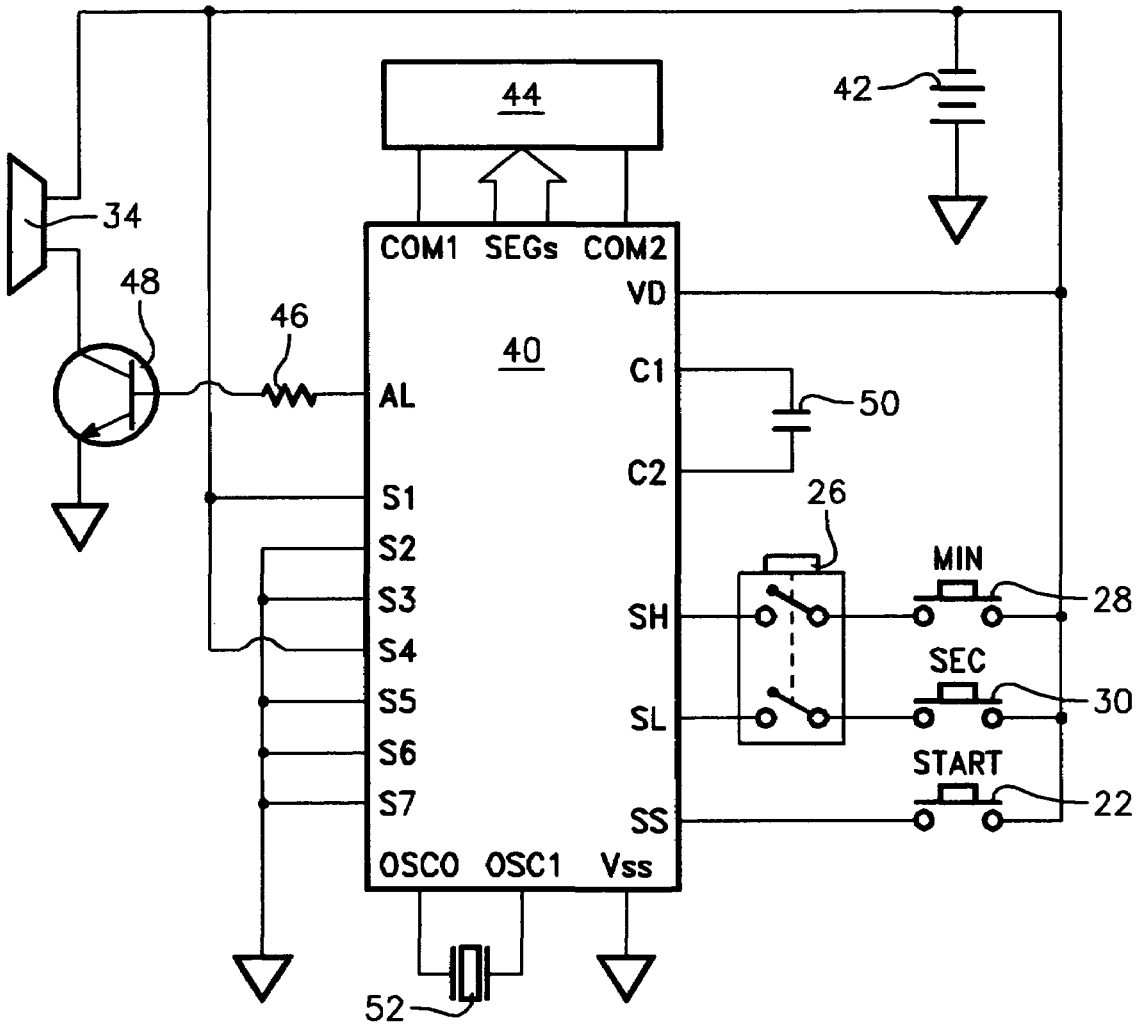
FIG. 3 is an electrical circuit diagram for the electronics that are contained within the housing of the interval timer of the present invention.

Opening 32 is to be in alignment with a sound producing speaker 34 which is shown in the circuitry of FIG. 3. Also mounted on the back side 16 are four in number of pedestals 36. Each pedestal 36 is to be located directly adjacent a corner of the back side 16 of the housing 12. Each of the pedestals 36 are the same size and shape and will generally be formed of a resilient material, such as rubber or plastic. The pedestals 36 are to be placed on a supporting surface 38.

The polygonal shape of housing 12 is preferred because after the timer 10 of the invention is programmed with the selected interval time, and such is preset, the timer 10 can then be placed with the pedestals 36 on a supporting surface which will locate window 20 and button 22 in a conveniently accessible position by a game player. The player can almost instantaneously activate the "counting down" procedure by quickly hitting the button 22. The fact that the housing 12 rests in a set position with slippage being prevented by the resilient pedestals and with the front side accessible, the user needs not to grasp the housing 12 for usage but only needs to quickly strike the button 22. The player can also quickly observe the amount of time remaining in window 20 at any instant.

Referring particularly to FIG. 3, there is shown the electronics that are incorporated in conjunction within the housing 12. This electronics utilizes a standard chip 40, part no. A1503, from China Semiconductor Company, Ltd., of Beijing, China. Power for this chip 40 is to be supplied by a battery 42 with generally a 1.5 volt battery being preferred. The chip 40 has a series of inputs S1, S2, S3, S4, S5, S6 and S7. S1 and S2 together control the maximum time that the interval timer 10 of this invention can count. For the present invention, S1 is held at "one" and S2 is held at "zero" which programs the chip 40 to allow maximum time of ninety-nine minutes and fifty-nine seconds. Input S3 is held at "zero" and has no purpose with regards to the present invention. S4 controls whether the chip will enter a power saving mode which would be where S4 equals "one" or not being in a power saving mode which would be where S4 equals "zero". In the power saving mode, nothing is displayed by the LCD 44 which would be displayed within the time display window 20. In the power saving mode, the chip 40 draws a negligible current. With the chip 40 in the power saving mode and a user presses pressable activating button 22, the chip 40 will then be placed in normal operating mode. For this invention, S4 equals "one".

The input S5 controls whether the timer counts up or down until a preset time interval has elapsed. When S5 equals "zero", the timer will count down and the LCD display 44 will start at the selected preset time interval value and decrease a second at a time until it reaches zero. When S5 equals "one" the timer will count up and the LCD display 44 starts at "zero" and is incremented until the selected preset time interval is reached. For this implementation, S5 equals "zero".

The input S6 controls whether an advance warning signal will be sent to the alarm output when the timer has counted to three minutes from completion. S6 will be at "zero" which turns off the advance warning signal function.

The input S7 controls whether the timer 10 operates in a one key mode where S7 equals "one" or a three key mode where S7 equals "zero". In the implementation of the present invention, S7 equals "zero" and the key inputs at SH, SL and SS are all active.

With the mode selection switch 26 in the set position, in other words closed, pressing of the minute button 28 causes 1.5 volts from the battery 42 to be applied to the SH input making SH equal "one". This causes the minutes value of the timer to increase rapidly until the button is released. If the maximum minutes value of ninety-nine minutes is reached, it starts over from zero. With the mode selection switch in the locked position, in other words open, pressing of the minute button 28 has no effect.

With the mode selection switch 26 in the set position, in other words closed, pressing of the seconds button 30 causes 1.5 volts from the battery 42 to be applied to the SL input (SL equal "one"). This causes the second value of the timer to increase rapidly until the button 30 is released. If the maximum set value is reached of fifty-nine seconds, it starts over from zero. With the mode selection switch 26 in the locked position, in other words open, pressing of the seconds button 30 will have no effect.

With the mode selection switch in the set position, in other words closed, pressing both of the minute button 28 and the second button 30 simultaneously which is where SH would equal "one" and SL equals "one" causes the timer to reset to zero. The purpose of the minutes button 28 and seconds button 30 is to allow the user to set the time interval that the interval timer 10 will be used to measure. Typically, once this selected preset time interval has been set and the mode selection switch 26 has been moved to the usage position, the user will not need to use these buttons again until it becomes necessary to change the selected preset time interval or to change the battery 42. When the power from the battery 42 is lost, the selected preset time interval is also lost.

The input SS becomes active when the pressable activating button 22 is pressed causing 1.5 volts to be applied to the SS input. Momentarily pressing the button 22 causes the timer to start decreasing from its interval value. Pressing it again causes the timer to stop at whatever time sequence is displayed when it was pressed, with this time sequence time value being displayed within the time display window 20. If the button 22 is pressed and held for more than two seconds, it causes the timer 10 of this invention to return to the selected preset time interval value.

Output signals from the chip 40 are as follows. At AL, the AL output provides an audio frequency signal through 1 kilo ohm resistor 46 to a transistor 48. The transistor 48 is turned on when the interval timer 10 completes counting from its selected preset time interval and has reached zero. This causes the speaker 34 to emit a sound. This signal to the speaker 34 is amplified by the transistor 48. The sound is to inform the players that the selected preset time interval has terminated.

The outputs COM1 and COM2 and SEGS emit signals which drive the LCD display 44. VD is the power input for the chip 40 with that same power input being transmitted to speaker 34 and aforementioned input signals. C1 and C2 are connected to a bypass capacitor 50 which will have a value of 0.1 μf (microfarads). This provides clock stabilization within the interval timer 10. OSC1 and OSC2 are connected to a 32 KhZ (kilohertz) crystal 52 and provides the frequency base for the counter built in the chip 40. VSS provides a ground reference for the chip 40.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be added for the device described, but also a method claim is added to address the method of making the invention. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An interval timer comprising:

a polygonal shaped housing having a front side and another side;

a time display screen mounted on said front side;

a pressable activating button mounted on said front side;

a mode selection switch mounted on the another side, said mode selection switch being movable between a usage position and a set position;

a first pressable time increment button mounted on said another side, when said first pressable button is pressed and said mode selection switch is in said set position said time display screen will display a first numerical time value and continued pressing of said first pressable time increment button will increase value of said first numerical time value and when said first pressable time increment button is no longer being pressed a specific desired value will be displayed in said time display screen;

a second pressable time increment button mounted on said another side, when said second pressable time increment button is pressed and said mode selection switch is in said set position said time display screen will display a second numerical time value and continued pressing of said second pressable time increment button will increase value of said second numerical time value and when said second pressable time increment button is no longer being pressed a specific desired value will be displayed in said time display screen;

movement of said mode selection switch to said usage position will result in both said specific desired values to be displayed as a selected preset interval time;

operation of said pressable activating button will result in said selected preset interval time to begin decreasing in minimum time increments toward a zero value; and electronics mounted within said housing for producing said selected preset interval time.

2. The interval timer as defined in claim 1 wherein:

there being only said time display screen and said pressure activating button mounted on said front side.

3. The interval timer as defined in claim 1 including:

a plurality of pedestals mounted on said another side, said pedestals being designed to facilitate locating of said housing on a supporting surface.

4. A method of constructing and using an interval timer comprising the steps of:

placing appropriate electronics within a polygonal shaped housing having a front side and an another side;

placing a time display screen and a pressable activating button in conjunction with said front side;

placing a mode selection switch, a first pressable time increment button and a second pressable time increment button in conjunction with said another side;

locating said mode selection switch in a set position;

pressing sequentially both said time increment buttons to produce by said electronics a selected preset interval time value to be displayed in said time display screen;

moving said mode selection switch to a usage position;

locating said front side to be accessible; and pressing said pressable activating button which causes said selected interval time to decrease a second at a time to eventually get to a zero value.

5. The method as defined in claim 4 wherein:

placing a plurality of pedestals on said another side which are to be placed against a supporting surface.

6. The method as defined in claim 4 wherein:

incorporating of a sound speaker with said electronics which is to produce an audible sound upon said zero value being displayed in said time display screen.

7. The method as defined in claim 4 wherein:

incorporating a battery within said housing to produce electrical power to said electronics.

* * * * *